US007273057B1

(12) United States Patent
Capaldo

(10) Patent No.: US 7,273,057 B1
(45) Date of Patent: Sep. 25, 2007

(54) TETHERED STYLING INSTRUMENT AND METHOD OF USE

(76) Inventor: David J Capaldo, 68 Reservoir Ave., Johnston, RI (US) 02919

( * ) Notice: Subject to any disclaimer, the term of this patent is extended or adjusted under 35 U.S.C. 154(b) by 0 days.

(21) Appl. No.: 11/013,086

(22) Filed: Dec. 15, 2004

Related U.S. Application Data

(60) Provisional application No. 60/532,647, filed on Dec. 24, 2003.

(51) Int. Cl.
*A45D 24/00* (2006.01)

(52) U.S. Cl. ..... 132/148

(58) Field of Classification Search ..... 132/148–150, 132/213.1, 128, 101, 312; D28/25; 63/3; 2/170; 30/296.1, 298
See application file for complete search history.

(56) References Cited

U.S. PATENT DOCUMENTS

| | | | | | |
|---|---|---|---|---|---|
| 413,678 | A | | 10/1889 | Noyes | |
| 452,156 | A | | 5/1891 | Bagshaw | |
| 452,830 | A | * | 5/1891 | Bowie | 224/220 |
| 581,635 | A | | 4/1897 | Walton | |
| 2,728,501 | A | * | 12/1955 | Hill | 224/219 |
| 2,827,055 | A | * | 3/1958 | Carden | 606/235 |
| 3,124,286 | A | * | 3/1964 | Dompier | 224/255 |
| 3,627,182 | A | * | 12/1971 | Calkins | 224/584 |
| D256,292 | S | * | 8/1980 | Cox | D3/206 |
| 4,265,448 | A | * | 5/1981 | Anderson, Jr. | 473/553 |
| 4,728,123 | A | * | 3/1988 | Kassal et al. | 280/822 |
| 4,804,122 | A | * | 2/1989 | Knox | 224/220 |
| 4,958,758 | A | | 9/1990 | Tipple et al. | |
| 4,982,641 | A | * | 1/1991 | Duhart | 84/329 |
| 5,131,151 | A | * | 7/1992 | Agase et al. | 30/327 |
| 5,163,206 | A | | 11/1992 | Hernandez | |
| D362,264 | S | * | 9/1995 | Trees | D17/20 |
| D377,862 | S | * | 2/1997 | Moore | D3/228 |
| 5,743,450 | A | | 4/1998 | Plate | |
| 6,047,705 | A | * | 4/2000 | Hawley | 132/128 |
| 6,325,077 | B1 | * | 12/2001 | Lark | 132/312 |
| 6,425,137 | B1 | * | 7/2002 | Fakhrai | 2/170 |
| 7,048,162 | B2 | * | 5/2006 | Frye et al. | 224/222 |
| 2005/0232682 | A1 | * | 10/2005 | Aguirre et al. | 401/131 |

* cited by examiner

*Primary Examiner*—Todd E. Manahan
*Assistant Examiner*—Rachel A. Running
(74) *Attorney, Agent, or Firm*—Salter & Michaelson

(57) ABSTRACT

A styling device manipulated by a user that includes a hand-held styling comb; a wrist band that is adapted for attachment about the wrist of the user; and a tether line having one end attached to the hand-held styling comb and the other opposite end attached to the wrist band. The tether line enables the hand-held styling comb to be secured to the wrist band for easy access by the user.

1 Claim, 8 Drawing Sheets

TETHERED STYLING INSTRUMENT AND METHOD OF USE

This is a nonprovisional application based on Provisional Application Ser. No. 60/532,647 filed on Dec. 24, 2003, the priority of which is claimed.

BACKGROUND

1. Technical Field

The present application is directed to a styling instrument and, in particular, to a tethered styling instrument. More particularly, the present invention relates to a tethered styling comb. The present invention also relates to a kit containing components of a styling instrument, and how they are to be assembled and used.

2. Background Discussion

Hair stylists generally comb out individual sections of hair prior to cutting each section, then change the comb to another hand where it is grasped tightly while cutting the section, and then changing back when needed moments later to comb the next section. Over time, the repetitive nature of these movements can causes painful problems such as tendinitis or carpal tunnel syndrome. In addition, hairstylists must disinfect combs whenever they are dropped, and replace the dropped comb with a clean one, which makes the cutting operation more time consuming than it needs to be.

SUMMARY OF THE INVENTION

The present invention overcomes the aforementioned problems by providing a tethered comb that allows a stylist to permit the comb to drop in between each cut, rather than switching the comb from hand-to-hand in between each cut. This eliminates some of the foregoing repetitive movements, and further eliminates the necessity for replacing combs when a stylist inadvertently drops a comb.

In accordance with the present invention there is provided a styling device manipulated by a user and comprising; a hand-held styling comb, a wrist band that is adapted for attachment about the wrist of the user, and a tether line having one end attached to the hand-held styling comb and the other opposite end attached to the wrist band. The tether line enables the hand-held styling comb to be secured to the wrist band for easy access by the user.

In accordance with other aspects of the present invention the hand-held comb may have, at one end teeth, and at the other end a handle; the wrist band may include an attachment means comprising a hook and loop segment for securing the wrist band in place about the users wrist; the tether line may include a barb at each end for respective attachment to the comb and wrist band; the comb may have at least one hole therein for receiving the barb at one end of the tether line; the wrist band may have means including a grommet for receiving the barb at the other end of the tether line; the barbs may each comprise a short rod member secured about a midpoint thereof to the tether line and having a diameter less than the hole in the comb for easy threading therethrough; the wrist band may include a means separate from the tether line for holding the comb, such as one or more slits in the wrist band.

In accordance with another aspect of the present invention there is provided a tethered device comprising: a hand-held implement that is adapted for use by a subject; a wrist band that is adapted for attachment about the wrist of the subject; and a tether line having one end attached to the hand-held implement and the other opposite end attached to the wrist band. The tether line enables the hand-held implement to be secured to the wrist band for easy access by the user, and prevents the hand held implement from falling to the ground. The tether line preferably has a barb at each end thereof in the form of a short rod member secured about a midpoint thereof to the tether line and having a diameter less than the hole in the comb for easy threading therethrough. The implement may comprise a styling device, eating utensil or other item.

In accordance with still another aspect of the present invention there is provided a kit for a tethered styling device comprising: at least one hand-held styling comb; a wrist band that is adapted for attachment about the wrist of a user; a tether line having one end that can be attached to the hand-held styling comb and the other opposite end that can be attached to the wrist band; an instruction sheet for the assembly and use of the comb, wrist band and tether line; and a holder for the comb, wrist band, tether line and instruction sheet. The holder may be transparent so that all items therein are observable. The transparent holder preferably has an opening flap and securing snap.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE PREFERRED EMBODIMENTS

In the following illustrated embodiments there is depicted a tethered comb that enables a stylist to allow the comb to drop in between each cut, rather than switching the comb from hand-to-hand in between each cut. This eliminates repetitive movements, and further eliminates the necessity for replacing combs when a stylist inadvertently drops a comb.

Figure 1:
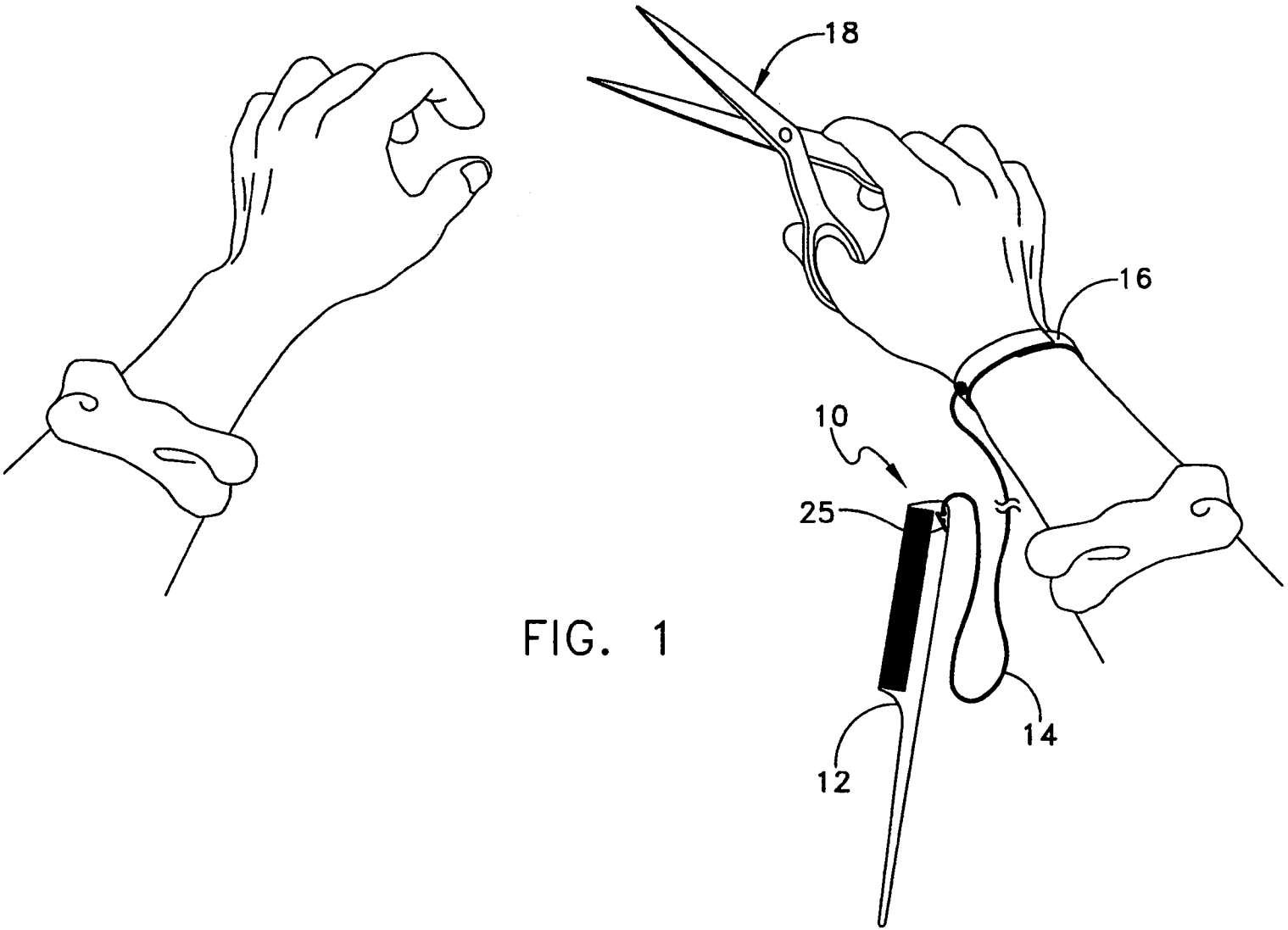
FIG. 1 illustrates a tethered styling comb according to the invention as attached to the right hand of a right-handed user.
Figure 2:
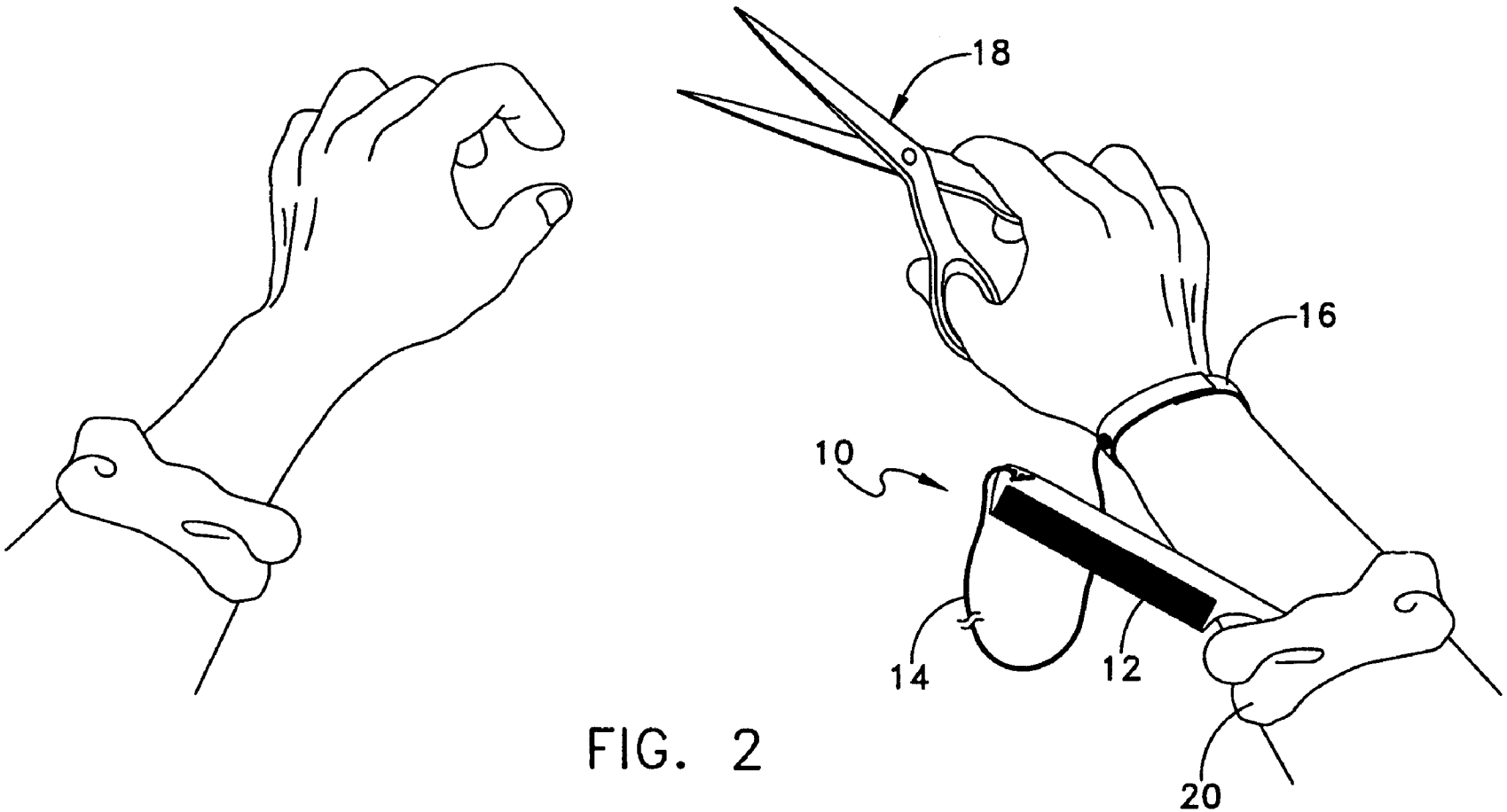
FIG. 2 is an illustration similar to that depicted in FIG. 1 showing the comb tucked into the user's sleeve.
Figure 3:
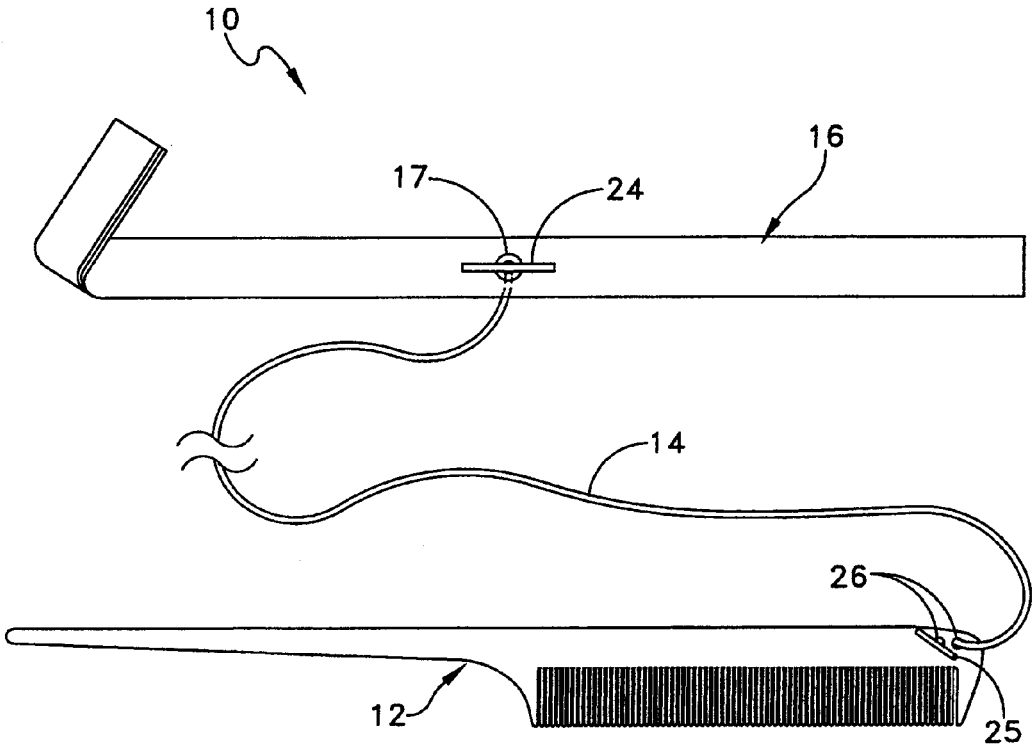
FIG. 3 depicts the wrist band, tether line and comb shown in FIG. 1 in a laid-out position.
Figure 10:
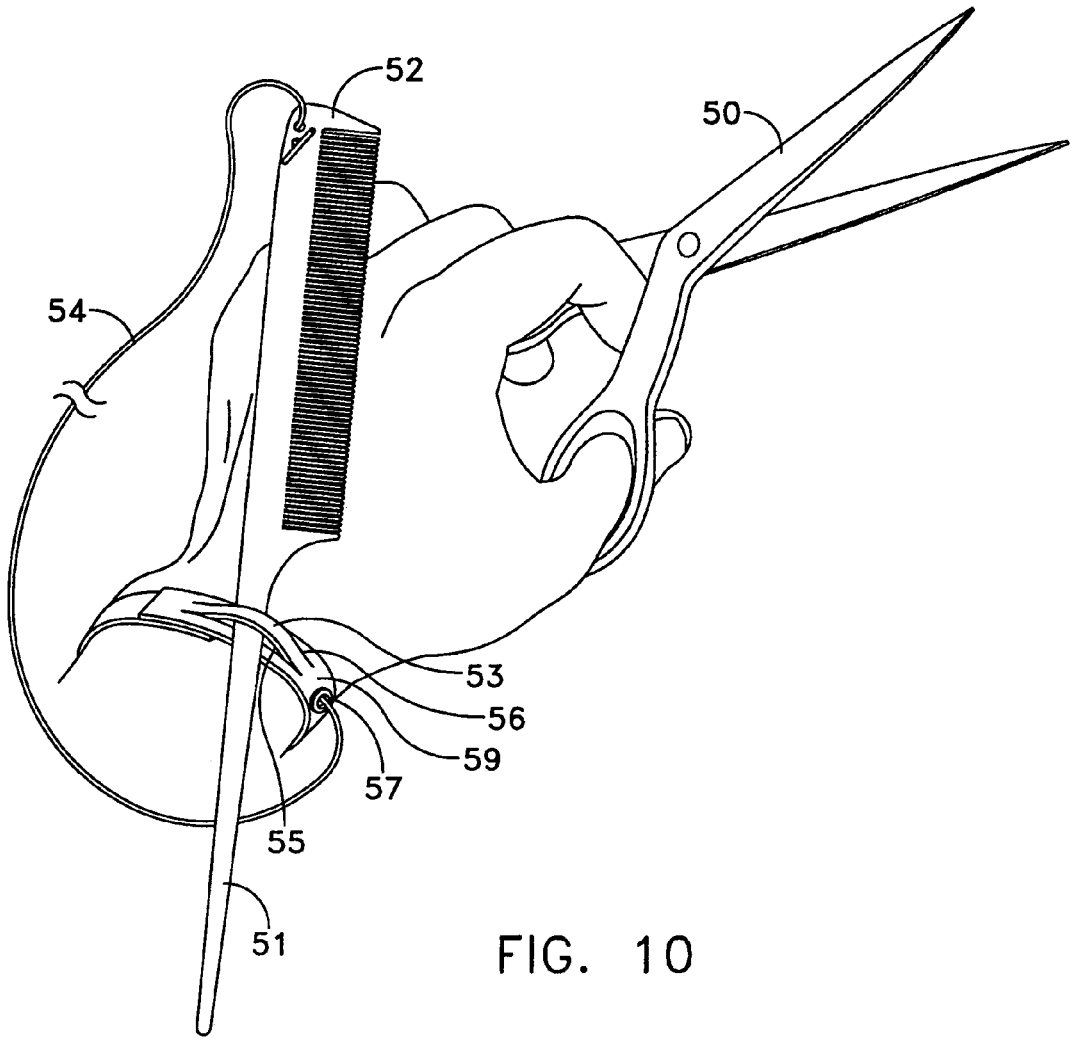
FIG. 10 is a view of a slightly different embodiment of the device of the present invention as used with a left-handed subject.
Figure 11:
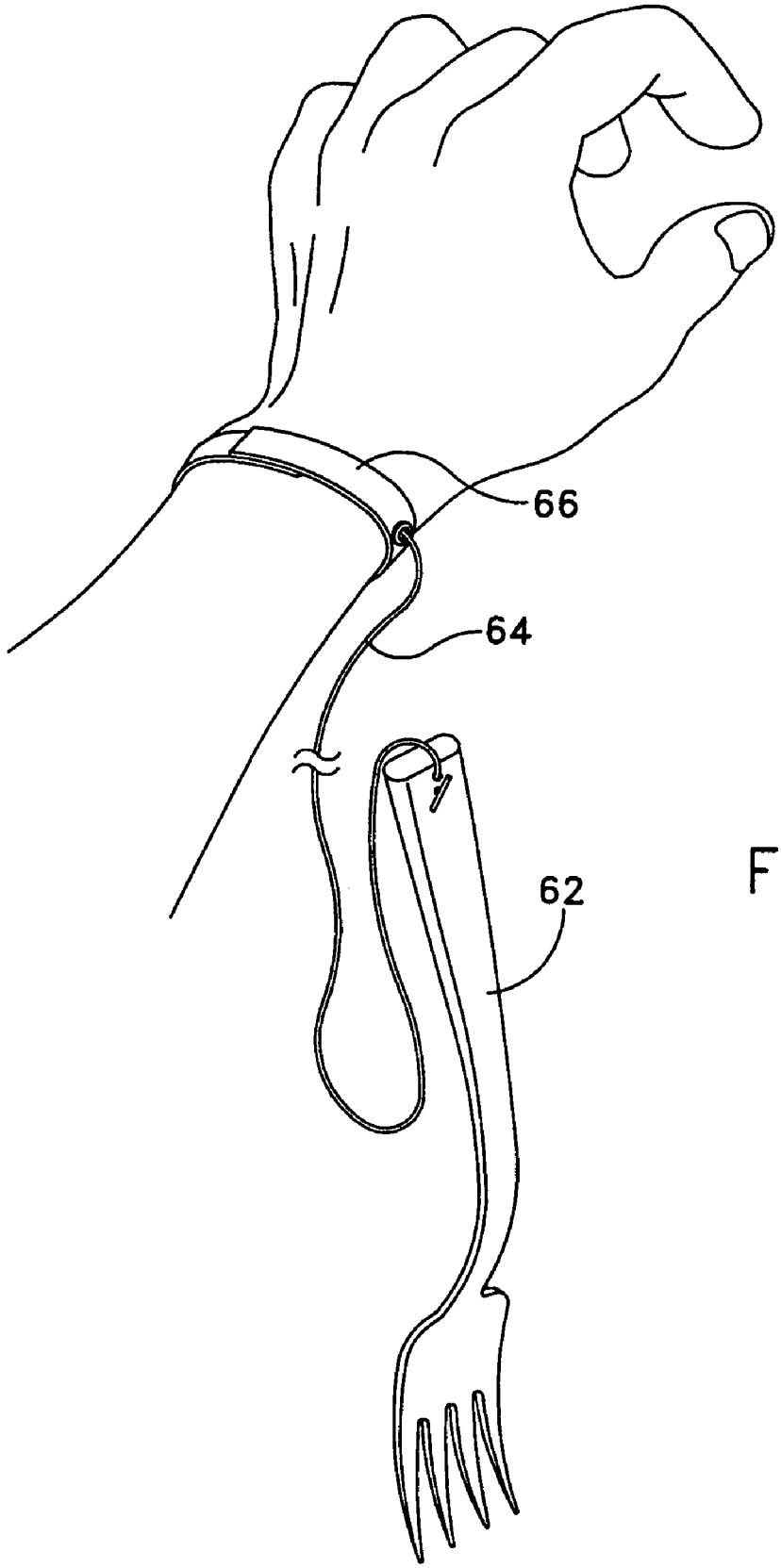
FIG. 11 illustrates the tethered device of the present invention in an embodiment in which an eating utensil is tethered to the wrist.
Figure 12:
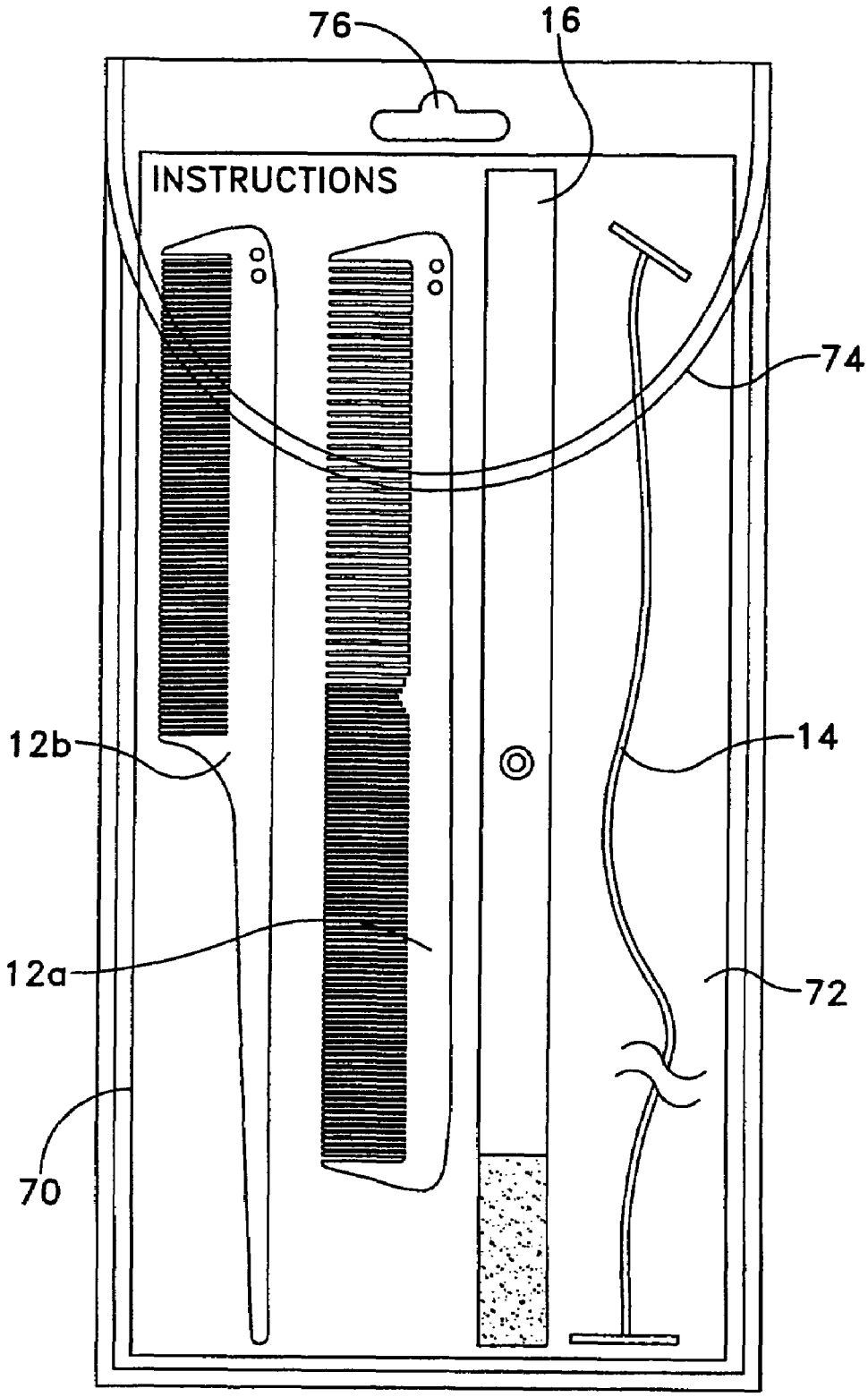
FIG. 12 depicts the kit for a tethered styling device as in accordance with the present invention.

FIGS. 1-3 illustrate a preferred embodiment of the tethered styling device or instrument of the present invention. FIGS. 4-9 illustrate various means for attaching the tether or tether line to the instrument, which in the illustrated embodiment is a comb. FIG. 10 is an illustration of an alternate embodiment in which the wristband also functions as a holder for the instrument. FIG. 11 illustrates a tether arrangement as used for supporting an eating utensil. Finally, FIG. 12 illustrates the kit containing the items previously described.

The preferred embodiment of the present invention illustrated in FIGS. 1-3 is shown as used with a right-handed subject. However, the tethered device of the present invention may be readily adapted for use either by a right-handed or left-handed subject. For example, FIG. 10 illustrates use with a left-handed subject.

In the embodiment of FIGS. 1-3 the device 10 includes a styling instrument, such as the illustrated comb 12, a strap 16 illustrated attached to the user's or subject's wrist, and a tether or tether line 14 that interconnects the styling instrument and the wrist strap.

In FIG. 1 the wrist strap 16 is shown attached to the right hand of the user for a right-handed subject. FIG. 1 also illustrates the scissors 18 being grasped by the right hand of the subject. FIG. 2 illustrates the handle of a comb 12 tucked into the sleeve cuff 20. Of course, the comb may also simply be dropped downwardly but prevented from falling to the ground by means of the tether line 14. The tether line is preferably of a length in a range of 5" to 15".

The styling instrument 12 may be any instrument used to style hair such as, for example, a comb, a brush, scissors, and the like, in any shape, size, color, or material. In a preferred embodiment, the styling implement is a comb 12. In the embodiment shown in FIGS. 1-9, comb 12 includes at least one device for receiving the tether for attachment which, in the present embodiment, are holes that are drilled through the comb. The comb 12 is typically made of a plastic material.

Strap 16 is adapted in size, shape and dimension to fit around the wrist of a user. Preferably, strap 16 is adjustable in length to accommodate wrists of varying diameter. Strap 16 can alternatively be constructed closed and in that case would slide over the wrist, or can be open and adapted to attach together at opposite ends. In the present embodiment, strap 16 is formed, partially or entirely from hook and loop tape so that it can be wrapped around a user's wrist and the ends can be attached together. Strap 16 includes a device 17 for attaching tether 14 thereto which in the present embodiment is an aperture, such as is defined by a grommet. The length, diameter and material from which strap 16 is constructed may be selected according to the particular needs of the user. In a preferred embodiment of the invention, the strap 16 is approximately ½ inch wide and has a laid-out length on the order of 10 inches. The hook and loop material can just be at the ends of the band or can be used throughout the entire band. The hook and loop material is a well known material for attaching between pieces and yet is also readily detachable by being pulled apart. The grommet 17 may provide a hole diameter on the order of ⅛ inch.

Tether 14 is adapted in size, shape and dimension according to the particular needs or desires of the stylist. For example, a taller individual may need a longer tether to accommodate the length of the individual's arm. Preferably, the length of the tether may be easily adjusted. In the preferred embodiment, tether 14 is constructed of an elastic material and has a length of approximately 10 inches. Metal barbs 24 and 25 are disposed at opposite ends of the tether 14, one of which is received into one of the holes in the comb and the other of which is received into the hole in the grommet of the strap 16.

FIG. 3 illustrates the components of the tethered styling instrument. In FIG. 3 the tether 16 has its barb 24 passing through the hole in the grommet 17 and its barb 25 passing through the two holes 26 in the front edge of the comb 12. It is noted that the tether 16 at each end is connected essentially at the mid-point of the length of the barb. The tether 16 is preferably of an elastic material although it may also be constructed of a more inelastic material. Each of the barbs is passed through a hole by inserting the rod-like member longitudinally through the hole. The tether material will deflect readily so that the barb can pass through the hole. Once disposed through the hole, then the barb can assume the position such as shown in FIG. 3 and is then fixedly attached with the respective item. On the wristband end of the tether, the barb is disposed so that it is on the inside of the wristband and thus is not observable, such as in the view of FIG. 1. At the comb end of the tether, it is noted in FIG. 3 that there are preferably two holes 26. By threading the tether in this manner, it is less likely to slide relative to the comb.

Figure 4:
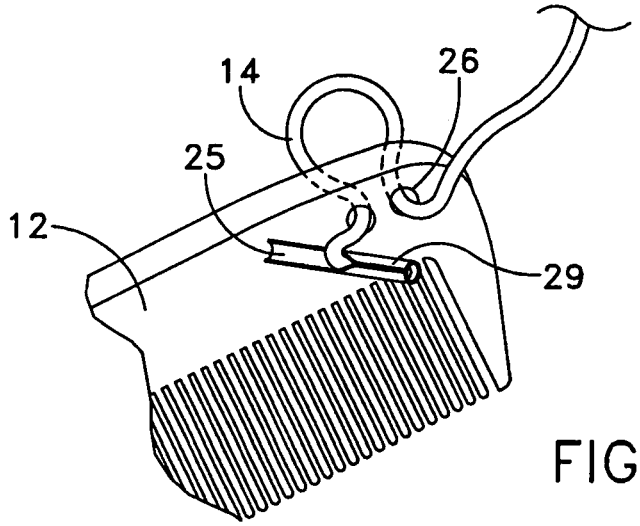
FIG. 4 is a fragmentary view of an end of the comb with one means of attachment between the comb and tether line using two holes.

FIG. 4 is a fragmentary view showing further details of the connection of the tether 14 with the comb 12. In this version there are two holes 26 and the barb 25 is illustrated as having been looped through the holes in a reversed direction leaving the barb in a position as illustrated in FIG. 4. This provides relatively firm interlocking of the end of the tether with the comb.

FIG. 4 also shows further details of the barb 25 which is in the form of an open metal piece crimped at 29 to hold the very end of the elastic tether 14 thereto. The tether 14 is thus attached to the barb 25 at about its mid-point along its length. The length of the barb may be on the order of ½-¾ inch and has a diameter less than the diameter of the holes 26. Even though the tether 14 is attached at the mid-point of the barb 25, the tether is readily deflectable so that the barb can be passed through either of the holes 26 quite readily.

Figure 5:
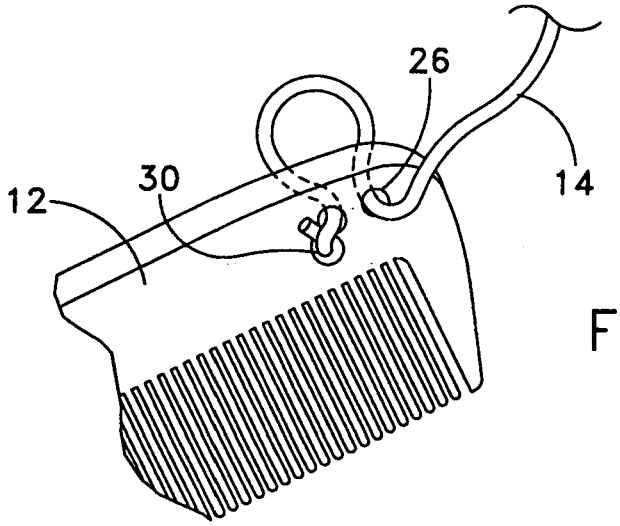
FIG. 5 is a fragmentary view of an end of the comb with another means of attachment between the comb and tether line using two holes.

FIG. 5 is a fragmentary view of an alternate construction in which the tether 14 is attached to the comb by means of a knot 30 at the end of the tether cord. In this arrangement the tether is first threaded through the holes and then the knot 30 is formed FIG. 6 is a further fragmentary view showing a ball end 32 to the tether 14 that prevents removal of the tether 14 from the comb at that end.

Figure 6:
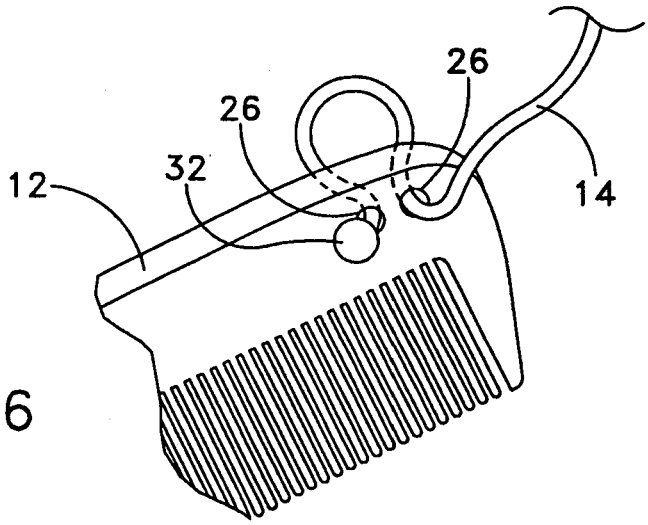
FIG. 6 is a fragmentary view of an end of the comb with still another means of attachment between the comb and tether line using two holes.
Figure 7:
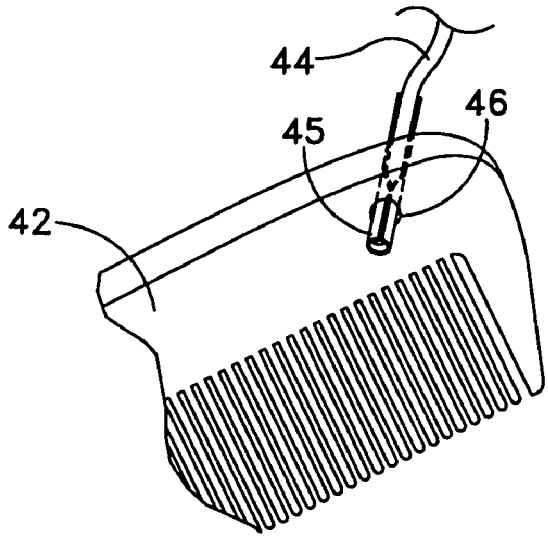
FIG. 7 is a fragmentary view of an end of the comb with a further means of attachment between the comb and tether line using one hole.
Figure 8:
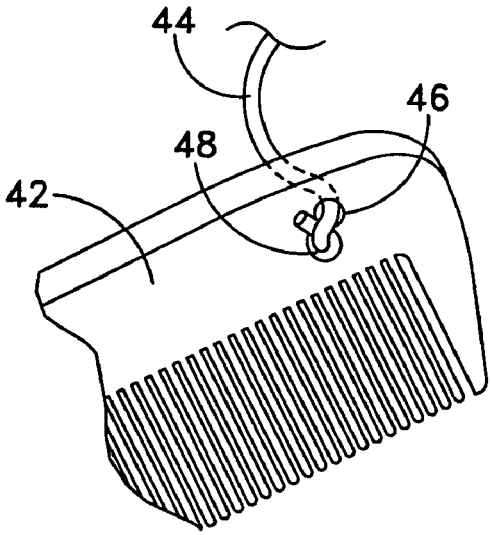
FIG. 8 is a fragmentary view of an end of the comb with still a further means of attachment between the comb and tether line using one hole.
Figure 9:
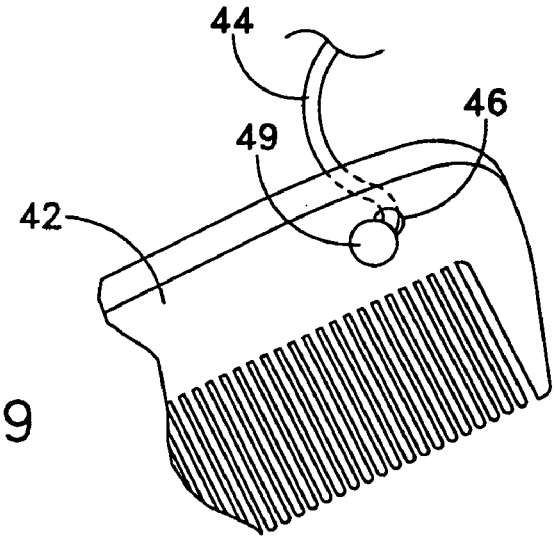
FIG. 9 is a fragmentary view of an end of the comb with a last means of attachment between the comb and tether line using one hole.

FIGS. 7-9 illustrate tether attachments similar to that described in respective FIGS. 4-6. However, in FIGS. 7-9 only a single hole 46 is used in the comb 42. The tether 44 is attached in a similar manner. For example, in FIG. 7 the barb 45 is used for attachment of the tether 44. In FIG. 7 the barb 45 is shown in an initial insertion position through the hole 46. In that position the tether simply deflects or turns while being inserted. In FIG. 8 the end of the tether 44 has a knot 48 for securing the tether to the comb. In FIG. 9 the tether 44 has a ball end 49 for securing the tether 44 to the comb 42.

Reference is now made to a further embodiment of the present invention in which the wristband 56 functions, not only as a place where the tether 54 is attached via grommet 57 but also functions as a means for holding the comb 52 to the wristband 56. The particular application illustrated in FIG. 10 is for a left-handed subject shown in FIG. 10 grasping the scissors 50.

In FIG. 10 the handle 51 of the comb is passed through a loop 53 on the wristband 56. The loop 53 is formed by means of a pair of slits 55, 56 in the wristband. With the arrangement of FIG. 10, rather than having the comb drop downwardly, or having it placed in a cuff, the comb can be readily accommodated until it needs to be used by being inserted under the loop 53 of the wristband. When it is necessary to use the comb, it can then easily be withdrawn from the wristband.

In use, the present tethered comb allows a stylist to simply allow the comb to drop while they are cutting hair rather than grasping it in the opposite hand. Thus, the pressure from this movement is relieved by allowing the stylist to allow the comb to drop. In addition, the tethered comb also eliminates the necessity for replacing combs when a stylist inadvertently drops a comb.

The preferred attachment is illustrated in FIGS. 4-6 with two attachment holes or apertures. The set of two spaced apart apertures are drilled at one end of comb 12. Preferably, the spacing is less than about 1 inch, more preferably less than ½ inch, and even more preferably less than about ¼ inch. If the comb has a handle end, then preferably the apertures are drilled at the end opposite to the handle end. Thus, when the comb is dropped, a user can grasp the handle without interference by the strap.

Reference is also now made to FIG. 11 illustrating the tether arrangement of the present arrangement as used for supporting an eating utensil. FIG. 11 illustrates a fork 62 tethered to the wristband 66 by means of tether line 64. The attachments at either end of the tether line 64 may be substantially identical to that previously described in connection with the embodiment illustrated in FIGS. 1-3.

The items that comprise the tethered styling instrument are illustrated in FIG. 12 in the form of a kit that includes combs 12*a* and 12*b*. One of these combs has a handle and the other does not. Also in the kit is the tether 14 and the wristband 16 shown in their elongated form. The tether 14 has the barbs at either end thereof. Also illustrated in FIG. 12 is an instruction sheet 70. The instruction sheet 70 along with the other items are adapted for being contained in a transparent holder 72 with the instruction sheet 70 disposed behind the other items. The holder 72 is preferably provided with a flap 74 with a top hole 76 to enable the holder to be supported from a peg, nail, or the like. A snap closure may also be provided between the holder and flap.

Of course it will be recognized that the present invention may be adapted for many other purposes and situation. For example, a similar situation occurs when grooming horses, when an individual sits on a horse to braid a mane and drops a comb. Another situation would be a drummer dropping a drumstick, which could be prevented by having the drumstick tethered to his/her wrist. The invention also may be adapted for eating utensils by including one or two spaced apart apertures at the handle end of the utensil, which would be helpful to, for example, children.

While this disclosure has been particularly shown and described with references to preferred embodiments thereof, it will be understood by those skilled in the art that various changes in form and details may be made therein without departing from the spirit and scope of the disclosure as defined by the appended claims.

What is claimed is:

1. A styling device manipulated by a user and comprising:

a hand-held styling comb;

a wrist band that is adapted for attachment about the wrist of the user;

and a tether line having one end attached to the hand-held styling comb and the other opposite end attached to the wrist band;

the tether line enabling the hand-held styling comb to be secured to the wrist band for easy access by the user;

wherein the hand-held comb has, at one end teeth, and at the other end an elongated handle; said wrist band includes an attachment means comprising a hook and loop segment for securing the wrist band in place about the users wrist; said tether line includes a barb at each end for respective attachment to the comb and wrist band; said comb has at least one hole therein only at the teeth end thereof for receiving the barb at one end of the tether line; said wrist band has means including a grommet for receiving the barb at the other end of the tether line; said barbs each comprise a short rod member secured about a midpoint thereof to the tether line and having a diameter less than the hole in the comb or wrist band for easy threading therethrough;

wherein the length of the tether line is in a range on the order of 5" to 15";

wherein the wrist band includes a means separate from the tether line for holding the comb;

wherein the separate means includes a pair of slits that define a loop for retaining the comb between the loop and side edges of the wrist band;

wherein said pair of slits extend longitudinally of the wrist band so as to hold the comb handle substantially in line with the users arm.

* * * * *